US010465461B2

(12) United States Patent
O'Brien et al.

(10) Patent No.: US 10,465,461 B2
(45) Date of Patent: Nov. 5, 2019

(54) APPARATUS AND METHODS SETTING A STRING AT PARTICULAR LOCATIONS IN A WELLBORE FOR PERFORMING A WELLBORE OPERATION

(71) Applicants: Robert S. O'Brien, Katy, TX (US); Jason A. Allen, Houston, TX (US); Andrew James Cayson, Cypress, TX (US); Geoffrey York Powers, Houston, TX (US)

(72) Inventors: Robert S. O'Brien, Katy, TX (US); Jason A. Allen, Houston, TX (US); Andrew James Cayson, Cypress, TX (US); Geoffrey York Powers, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 688 days.

(21) Appl. No.: 14/487,828

(22) Filed: Sep. 16, 2014

(65) Prior Publication Data

US 2015/0075815 A1 Mar. 19, 2015

Related U.S. Application Data

(60) Provisional application No. 61/878,341, filed on Sep. 16, 2013, provisional application No. 61/878,383, filed on Sep. 16, 2013.

(51) Int. Cl.
*E21B 23/02* (2006.01)
*E21B 23/01* (2006.01)
(Continued)

(52) U.S. Cl.
CPC ..... *E21B 23/02* (2013.01); *E21B 17/02* (2013.01); *E21B 23/006* (2013.01); *E21B 23/01* (2013.01); *E21B 43/108* (2013.01)

(58) Field of Classification Search
CPC ..... E21B 23/00; E21B 23/01; E21B 23/02; E21B 23/006
See application file for complete search history.

(56) References Cited

U.S. PATENT DOCUMENTS 80,875 A 8/1868 Platt et al.
85,428 A 12/1868 Burditt et al.
(Continued)

FOREIGN PATENT DOCUMENTS

EP 1001132 A2 5/2000
WO 0026501 A1 5/2000
(Continued)

OTHER PUBLICATIONS

PCT International Search Report and Written Opinion; International Application No. PCT/US2015/014607; International Filing Date: Feb. 5, 2015; dated May 19, 2015; pp. 1-10.
(Continued)

*Primary Examiner* — Robert E Fuller
(74) *Attorney, Agent, or Firm* — Cantor Colburn LLP

(57) ABSTRACT

An apparatus for use in a wellbore is disclosed that in one non-limiting embodiment includes a set down tool that includes a locating device configured to engage with an outer member at a selected location, a set down device configured to set down in a set down profile in the outer member when the set down device is activated, an alignment device for activating the set down device and a locking device that operates the alignment device to activate the set down device while maintaining the locating device engaged with the outer member.

10 Claims, 6 Drawing Sheets

(51) Int. Cl.

| | |
|---|---|
| ***E21B 17/02*** | (2006.01) |
| ***E21B 23/00*** | (2006.01) |
| ***E21B 43/10*** | (2006.01) |

(56) References Cited

U.S. PATENT DOCUMENTS

| | | | | |
|---|---|---|---|---|
| 1,342,813 | A | 6/1920 | Huston | |
| 3,025,914 | A | 3/1962 | Fether | |
| 3,133,595 | A | 5/1964 | Loughney et al. | |
| 3,356,145 | A | 12/1967 | Fredd | |
| 3,504,936 | A | 4/1970 | Brown et al. | |
| 3,677,346 | A * | 7/1972 | Tamplen | E21B 23/006 166/125 |
| 3,726,546 | A | 4/1973 | Brown | |
| 3,856,081 | A * | 12/1974 | Canalizo | E21B 23/02 166/123 |
| 4,125,129 | A | 11/1978 | Baumann | |
| 4,176,717 | A | 12/1979 | Hix | |
| 4,267,045 | A | 5/1981 | Hoof | |
| 4,281,858 | A | 8/1981 | Bower | |
| 4,369,840 | A * | 1/1983 | Szarka | E21B 23/006 166/214 |
| 4,423,889 | A | 1/1984 | Weise | |
| 4,778,008 | A | 10/1988 | Gonzalez et al. | |
| 4,840,229 | A * | 6/1989 | Proctor | E21B 23/006 166/217 |
| 5,044,433 | A | 9/1991 | Rubbo et al. | |
| 5,092,402 | A | 3/1992 | Perricone et al. | |
| 5,122,271 | A | 6/1992 | Simon et al. | |
| 5,341,880 | A | 8/1994 | Thorstensen | |
| 5,513,703 | A * | 5/1996 | Mills | E21B 23/04 166/316 |
| 5,769,122 | A | 6/1998 | Baumann et al. | |
| 5,823,264 | A | 10/1998 | Ringgenberg | |
| 6,003,607 | A | 12/1999 | Hagen et al. | |
| 6,367,552 | B1 | 4/2002 | Scott et al. | |
| 6,447,021 | B1 | 9/2002 | Haynes | |
| 6,978,840 | B2 | 12/2005 | Henderson | |
| 7,055,598 | B2 | 6/2006 | Ross et al. | |
| 7,086,479 | B2 | 8/2006 | Schultz et al. | |
| 7,284,606 | B2 | 10/2007 | Coronado | |
| 7,578,343 | B2 | 8/2009 | Augustine | |
| 7,673,678 | B2 | 3/2010 | MacDougall et al. | |
| 8,061,430 | B2 | 11/2011 | Du et al. | |
| 8,201,623 | B2 | 6/2012 | O'Brien | |
| 8,220,555 | B1 | 7/2012 | Wintill et al. | |
| 8,286,701 | B2 | 10/2012 | Schultz et al. | |
| 8,403,061 | B2 | 3/2013 | Russell et al. | |
| 8,403,064 | B2 | 3/2013 | Allen | |
| 8,424,609 | B2 | 4/2013 | Duphorne et al. | |
| 8,474,542 | B2 * | 7/2013 | Blanton | E21B 23/02 166/217 |
| 2002/0092653 | A1 | 7/2002 | Scott et al. | |
| 2002/0117301 | A1 | 8/2002 | Womble | |
| 2003/0029621 | A1 | 2/2003 | Haynes | |
| 2003/0141059 | A1 | 7/2003 | Mauldin et al. | |
| 2003/0188894 | A1 | 10/2003 | Sunde et al. | |
| 2005/0039916 | A1 | 2/2005 | Schultz et al. | |
| 2006/0027377 | A1 | 2/2006 | Schoonderbeek et al. | |
| 2006/0219413 | A1 | 10/2006 | Vilela et al. | |
| 2006/0260818 | A1 | 11/2006 | Meijer et al. | |
| 2007/0131434 | A1 | 6/2007 | MacDougall et al. | |
| 2009/0133874 | A1 | 5/2009 | Dale et al. | |
| 2010/0163250 | A1 | 7/2010 | Schultz et al. | |
| 2010/0224375 | A1 | 9/2010 | Du et al. | |
| 2010/0252250 | A1 | 10/2010 | Fripp et al. | |
| 2011/0048706 | A1 | 3/2011 | Clem et al. | |
| 2011/0079396 | A1 | 4/2011 | Russell et al. | |
| 2011/0127047 | A1 | 6/2011 | Themig et al. | |
| 2011/0146988 | A1 | 6/2011 | McGlothen | |
| 2011/0186286 | A1 | 8/2011 | Allen | |
| 2011/0209873 | A1 | 9/2011 | Stout | |
| 2011/0226481 | A1 | 9/2011 | Duphorne et al. | |
| 2011/0278017 | A1 | 11/2011 | Themig et al. | |
| 2012/0085544 | A1 | 4/2012 | Shilling et al. | |
| 2012/0085548 | A1 | 4/2012 | Fleckenstein et al. | |
| 2013/0048305 | A1 | 2/2013 | Xu et al. | |
| 2013/0108356 | A1 | 5/2013 | Stautzenberger et al. | |
| 2013/0112410 | A1 | 5/2013 | Szarka et al. | |
| 2013/0199799 | A1 | 8/2013 | Phan et al. | |
| 2014/0116699 | A1 | 5/2014 | Helms et al. | |
| 2014/0158357 | A1 | 6/2014 | Lyashkov et al. | |
| 2014/0166312 | A1 | 6/2014 | Richards et al. | |
| 2014/0318780 | A1 | 10/2014 | Howard | |
| 2015/0129239 | A1 | 5/2015 | Richard | |
| 2015/0252628 | A1 | 9/2015 | Cochran et al. | |
| 2015/0375144 | A1 | 12/2015 | Greci | |
| 2016/0069145 | A1 | 3/2016 | McGuire et al. | |
| 2016/0076337 | A1 | 3/2016 | Harper et al. | |
| 2016/0084018 | A1 | 3/2016 | Allen | |
| 2016/0123093 | A1 | 5/2016 | Richards et al. | |
| 2016/0153248 | A1 | 6/2016 | Richards et al. | |
| 2017/0183919 | A1 | 6/2017 | Cochran et al. | |

FOREIGN PATENT DOCUMENTS

| | | | |
|---|---|---|---|
| WO | 2007078375 | A2 | 7/2007 |
| WO | 2012162792 | | 12/2012 |
| WO | WO2012162792 | A1 | 12/2012 |

OTHER PUBLICATIONS

PCT International Search Report and Written Opinion; International Application No. PCT/US2015/017515; International Filing Date: Feb. 25, 2015; dated Jun. 8, 2015; 16 pages.

PCT International Search Report and Written Opinion, International Application No. PCT/US2014/055889; International Filing Date: Sep. 16, 2014; dated Dec. 23, 2014; pp. 1-10.

PCT International Search Report and Written Opinion; International Application No. PCT/US2014/055886; International Filing Date: Sep. 16, 2014; dated Dec. 19, 2014; pp. 1-9.

PCT International Search Report and Written Opinion; International Application No. PCT/US2014/055887; International Filing Date: Sep. 16, 2014; dated Dec. 18, 2014; pp. 1-10.

* cited by examiner

APPARATUS AND METHODS SETTING A STRING AT PARTICULAR LOCATIONS IN A WELLBORE FOR PERFORMING A WELLBORE OPERATION

CROSS-REFERENCE TO RELATED APPLICATIONS

This application takes priority from U.S. Provisional application Ser. No. 61/878,341, filed on Sep. 16, 2013; and U.S. Provisional Application Ser. No. 61/878,383, filed on Sep. 16, 2013 and assigned to the assignee of this application, each of which is incorporated herein in its entirety by reference.

BACKGROUND

1. Field of the Disclosure

This disclosure relates generally to apparatus and methods for completing a wellbore for the production of hydrocarbons from subsurface formations, including fracturing selected formation zones in a wellbore, sand packing and flooding a formation with a fluid.

2. Background of the Art

Wellbores are drilled in subsurface formations for the production of hydrocarbons (oil and gas). Modern wells can extend to great well depths, often more than 1500 meters. Hydrocarbons are trapped in various traps in the subsurface formations at different depths. Such sections of the formation are referred to as reservoirs or hydrocarbon-bearing formations or zones. Some formations have high mobility, which is a measure of the ease of the hydrocarbons flow from the reservoir into a well drilled through the reservoir under natural downhole pressures. Some formations have low mobility and the hydrocarbons trapped therein are unable to move with ease from the reservoir into the well. Stimulation methods are typically employed to improve the mobility of the hydrocarbons through the reservoirs. One such method, referred to as fracturing (also referred to as "fracing" or "fracking"), is often utilized to create cracks in the reservoir to enable the fluid from the formation (formation fluid) to flow from the reservoir into the wellbore. To fracture multiple zones, an assembly containing an outer string with an inner string therein is run in or deployed in the wellbore. The outer string is conveyed in the wellbore with a tubing attached to its upper end and it includes various devices corresponding to each zone to be fractured for supplying a fluid with proppant to each such zone. The inner string includes devices attached to a tubing to operate certain devices in the outer string and facilitate fracturing and/or other well treatment operations. For selectively treating a zone in a multi-zone wellbore, it is desirable to have an inner sting that can be selectively set corresponding to any zone in a multi-zone well and perform a well operation at such selected zone.

The disclosure herein provides apparatus and methods for setting the inner string at a selected location in the outer string.

SUMMARY

In one aspect, an apparatus for use in a wellbore is disclosed that in one non-limiting embodiment includes a set down tool that includes a locating device configured to engage with an outer member at a selected location, a set down device configured to set down in a set down profile in the outer member when the set down device is activated, an alignment device for activating the set down device and a locking device that operates the alignment device to activate the set down device while maintaining the locating device engaged with the outer member.

in another aspect, a method of performing an operation in a wellbore is disclosed that in one non-limiting embodiment includes: conveying a service assembly into a wellbore, the service assembly including an outer string having a plurality of spaced apart locating profiles and a set down profile and an inner string having a set down tool that includes: a locating device configured to engage with a locating profile on the outer string at a selected location; a set down device configured to set down in the set down profile in the outer string when the set down device is activated; and an alignment device for activating the set down device; and a locking device configured to cause the alignment device to activate the set down device while maintaining the locating device engaged with the locating profile: engaging the locating device with a selected locating profile; operating the alignment device by the locking device to activate the set down device, while maintaining the locating device engaged with the selected locating profile; and moving the set down tool to set down the set down device in the set down profile.

Examples of the more important features of a well completion system and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
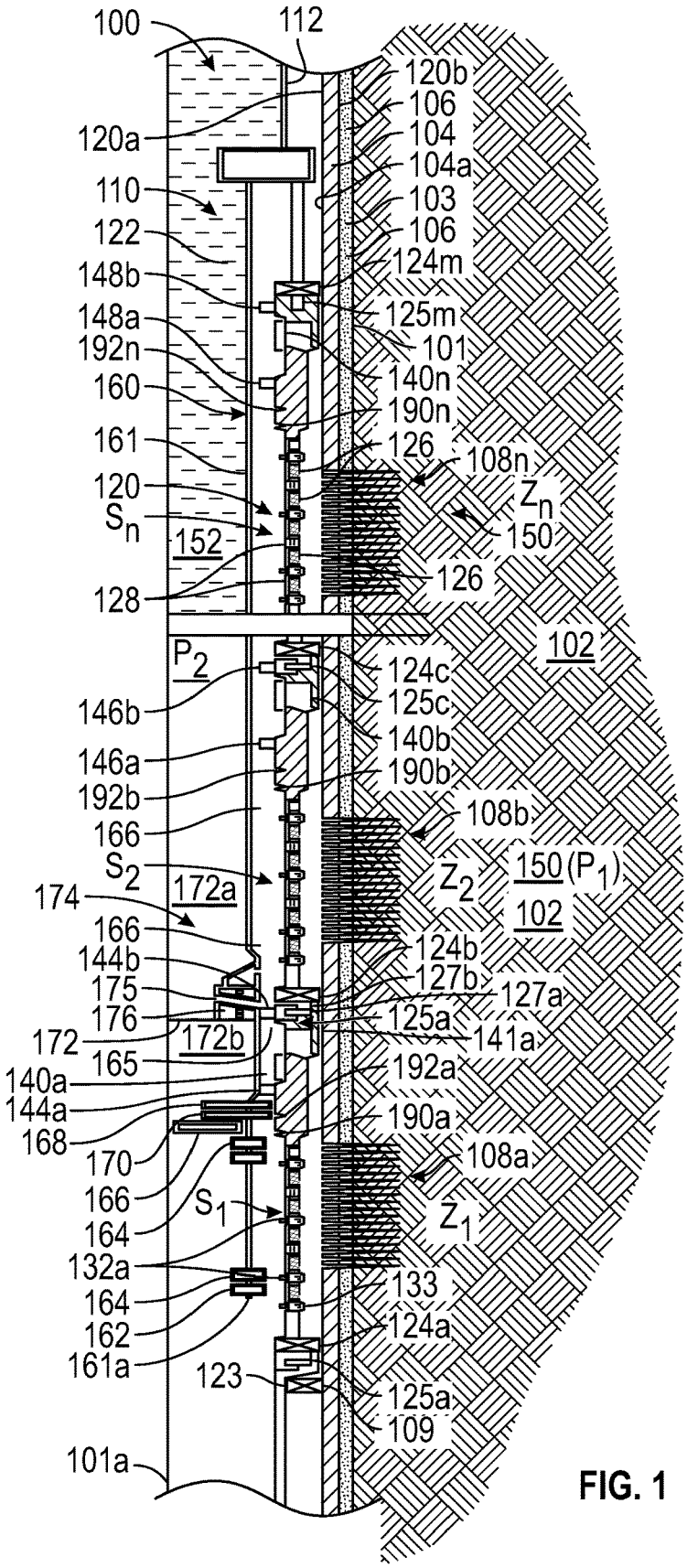
FIG. 1 shows an exemplary cased hole multi-zone wellbore with a service assembly deployed therein that includes an outer string and an inner string, wherein the inner string includes a setting or set down tool made according to one non-limiting embodiment of the present disclosure.

FIG. 1 is a line diagram of a section of a wellbore system 100 that is shown to include a wellbore 101 formed in formation 102 for performing a treatment operation therein, such as fracturing the formation (also referred to herein as fracing or fracking), gravel packing, flooding, etc. The wellbore 101 is lined with a casing 104, such as a string of jointed metal pipes sections, known in the art. The space or annulus 103 between the casing 104 and the wellbore 101 is filled with cement 106. The particular embodiment of FIG. 1 is shown for selectively fracking one or more zones in any selected or desired sequence or order. However, wellbore 101 may be configured to perform other treatment or service operations, including, but not limited to, gravel packing and flooding a selected zone to move fluid in the zone toward a production well (not shown). The formation 102 is shown to include multiple zones Z1-Zn which may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a*, Zone Z2 perforations 108*b*, and Zone Zn perforations 108*n*. The perforations in each zone provide fluid passages for fracturing each such zone. The perforations also provide fluid passages for formation fluid 150 to flow from the formation 102 to the inside 104*a* of the casing 104. The wellbore 101 includes a sump packer 109 proximate to the bottom 101*a* of the wellbore 101. The sump packer 109 is typically deployed after installing casing 104 and cementing the wellbore 101. The sump packer 109 is tested to a pressure rating before treating the well, such as fracturing and packing, which pressure rating may be below the expected pressures in the wellbore 101 after a zone has been treated and isolated.

After casing, cementing, perforating and sump packer deployment, the wellbore 101 is ready for treatment operations, such as fracturing and gravel packing of each of the production zones Z1-Zn. Although system 100 is described in reference to fracturing and sand packing production zones, the apparatus and methods described herein or with obvious modifications may also be utilized for other well treatment operations, including, but not limited to, gravel packing and water flooding. The formation 102 has a fluid 150 therein at formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 150 from the formation 102 into the casing 104 and prevents blow-outs.

Still referring to FIG. 1, to fracture (treat) one or more zones Z1-Zn, a system assembly 110 is run inside the casing 104 by a conveying member 112, which may be a tubular made of jointed pipe section, known in the art. In one non-limiting embodiment, the system assembly 110 includes an outer string 120 and an inner string 160 placed inside the outer string 120. The outer string 120 includes a pipe 122 and a number of devices associated with each of the zones Z1-Zn for performing treatment operations described in detail below. In one non-limiting embodiment, the outer string 120 includes a sealing member 123*a*, outside and proximate to a bottom end 123 of the outer string 120. The outer string 120 further includes a lower packer 124*a*, an upper packer 124*m* and intermediate packers 124*b*, 124*c*, etc. The lower packer 124*a* isolates the sump packer 109 from hydraulic pressure exerted in the outer string 120 during fracturing and sand packing of the production zones Z1-Zn. In this case the number of packers in the outer string 120 is one more than the number of zones Z1-Zn. In some cases, the lower packer 109, however, may be utilized as the lower packer 124*a*. In one non-limiting embodiment, the intermediate packers 124*b*, 124*c*, etc. may be configured to be independently deployed in any desired order so as to fracture and pack any of the zones Z1-Zn in any desired order. In another embodiment, some or all the packers may be configured to be deployed at the same time or substantially at the same time. In one aspect, packers 124*a*-124*m* may be hydraulically set or deployed packers. In another aspect, packers 124*a*-124*m* may be mechanically set or deployed.

Still referring to FIG. 1, the outer string 120 further includes a screen adjacent to each zone. For example, screen S1 is shown placed adjacent to zone Z1, screen S2 adjacent zone Z2 and screen Sn adjacent to zone Zn. The lower packer 124*a* and intermediate packer 124*b*, when deployed, will isolate zone Z1 from the remaining zones: packers 124*b* and 124*c* will isolate zone Z2 and packers 124*m*-1 and 124*m* will isolate zone Zn. In one non-limiting embodiment, each packer has an associated packer activation device, such as a valve, that allows selective deployment of its corresponding packer in any desired order. In FIG. 1, a packer activation device 125*a* is associated with the lower packer 124*a*, device 125*b* with intermediate packer 124*b*, device 125*c* with intermediate packer 124*c* and device 125*m* with the upper packer 124*m*. In one aspect, packers 124*a*-224*m* may be hydraulically-activated packers. In one aspect, the lower packer 124*a* and the upper packer 124*m* may be activated at the same or substantially the same time when a fluid under pressure is supplied to the pipe 112. In one non-limiting embodiment, the activation devices associated with the intermediate packers 124*b*, 124*c*, etc. may include a balanced piston device that remains under a balanced pressure condition (also referred to herein as the "inactive mode") to prevent a pressure differential between the inside 120*a* and outside 120*b* of the outer sting 120 to activate the packer. When a packer activation device is activated by an external mechanism, such mechanism allows pressure of the fluid in the outer string 120 to cause its associated packer to be set or deployed.

Still referring to FIG. 1, in one non-limiting embodiment, each of the screens S1-Sn may be made by serially connecting two or more screen sections with interconnecting connection members to form a screen of a desired length, wherein the interconnections provide axial fluid communication between the adjacent screen sections. For example, screen Sn is shown to include screen sections 126 interconnected by connections 128. The connections 128 may include a flow communication device, such as a sliding sleeve valve or sleeve 133, to provide flow of the fluid 150 from the formation 102 into the outer string 120. Similarly, other screens may also include several screen sections and corresponding connection devices. The connections 128 allow axial flow between the screen sections 126. The outer string 120 also includes, for each zone, a flow control device, referred to as a slurry outlet or a gravel exit, such as a sliding sleeve valve or another valve, uphole or above its corresponding screen to provide fluid communication between the inside 120*a* of the outer string 120 and each of the zones Z1-Zn. As shown in FIG. 1, a slurry outlet 140*a* is provided for zone Z1 between screen S1 and its intermediate packer 124*b*, outlet 140*b* for zone Z2 and outlet 140*n* for zone Zn. In FIG. 1, device 140*a* is shown open while devices 140*b*-140*n* are shown closed so no fluid can flow from the inside 120*a* of the outer string 120 to any of the zones Z2-Zn, until opened downhole.

In yet another aspect, the outer string 120 may further include an inverted seal below and another above each inflow control device for performing a treatment operation. In FIG. 1, inverted seals 144*a* and 144*b* are shown associated with slurry outlet 140*a*, inverted seals 146*a* and 146*b* with the slurry outlet 140*b* and inverted seals 148*a* and 148*b* with slurry outlet 140*n*. In one aspect, the inverted seals 144*a*, 144*b*, 146*a*, 146*b*, 148*a* and 148*b* may be configured so that they can be pushed inside 120*a* of the outer string 120 or removed from the inside of the outer string 120 after completion of the treatment operations or during the deployment of a production string (not shown) for the production of hydrocarbons from wellbore 101. Pushing inverted seals 144*a* and 144*b* inside 120*a* of the outer string 120 or removing such seals from the inside 120*a* of the outer string 120 provides increased inside diameter of the outer string 120 for the installation of a production string for the production of hydrocarbons from zones Z1-Zn compared to an outer string having seals extending inside 120*a* the outer string 120. Seals 144*a*, 144*b*, 146*a*, 146*b*, 148*a* and 148*b* may, however, be placed on the outside of the inner string instead on the inside of the outer string. In one non-limiting embodiment, the outer string 120 also includes a zone indicating profile or locating profile (profile 190*a* for zone Z1, profile 190*b* for zone Z2 and profile 190*n* for zone Zn) for each zone and a corresponding set down profile (192*a* for zone Z1, 192*b* for zone Z2 and 192*n* for zone Zn).

Still referring to FIG. 1, the inner string 160 (also referred to herein as the service string) may be a metallic tubular member 161 that in one embodiment includes an opening shifting tool 162 and a closing shifting tool 164 along the lower end 161*a* of the inner string 160. The inner string 160 further may include a reversing valve 166 that enables the removal of treatment fluid from the wellbore after treating each zone, and an up-strain locating tool 168 for locating a location uphole of each set down locations, such as location 190*a* for zone Z1, 190*b* for zone Z2 and 190*n* for Zone Zn, when the inner string 120 is pulled uphole. A set down tool or set down locating tool 170 is configured to selectively locate a zone, which may then be set down at such selected location for performing a treatment operation. The inner string 160 includes a plug 172 above the set down 170, which prevents fluid communication between the space 172*a* above the plug 172 and the space 172*b* below the plug 172. The inner string 160 further includes a crossover tool (also referred to herein as the "frac port" 174) for providing a fluid path 175 between the inner string 160 and the outer string 120. In one aspect, the frac port 174 also includes flow passages 176 therethrough, which passages may be gun-drilled through the frac port 174 to provide fluid communication between space 172*a* and 172*b*. In one embodiment, the passages 176 are sufficiently narrow that the fluid flow through such passages is relatively small. The passages 176, however, are sufficient to provide fluid flow and thus pressure communication between spaces 172*a* and 172*b*.

To perform a treatment operation in a particular zone, for example zone Z1, lower packer 124*a* and upper packer 124*m* are set or deployed. Setting the upper 124*m* and lower packer 124*a* anchors the outer string 120 inside the casing 104. The production zone Z1 is then isolated from all the other zones. To isolate zone Z1 from the remaining zones Z2-Zn, the inner string 160 is manipulated so as to cause the opening tool 164 to open a monitoring valve 133*a* in screen S1. The inner string 160 is then manipulated (moved up and/or down) inside the outer string 120 so that the set down tool 170 locates the locating or indicating profile 190*a*. The set down tool 170 is then manipulated to cause it to set down in the set down profile 192*a*. When the set down tool 170 is set down at location 192*a*, the frac port 174 is adjacent to the slurry outlet 140*a*. The pipe 161 of the inner string 160 has a sealing section that comes in contact with the Inverted seals 144*a* and 144*b*, thereby isolating or sealing section 165 between the seals 144*a* and 144*b* that contains the slurry outlet 140*a* and the frac port 174 adjacent to slurry outlet 140*a*, while providing fluid communication between the inner string and the slurry outlet 140*a*. Sealing section 165 from the section 169 allows the lower port 127*a* of the packer setting device 125*b* to be exposed to the pressure in the section 165 while the upper port 127*b* is exposed to pressure in section 169. The packer 124*b* is then set to isolate zone Z1. Once the packer 124*b* has been set, frac sleeve 140*a* is opened, as shown in FIG. 1, to supply slurry or another fluid to zone Z1 to perform a fracturing or a treatment operation. Once zone Z1 has been treated, the treatment fluid in the wellbore 101 is removed by the use of the reversing valve 166. The inner string 160 may then be moved so that the set down tool 170 at another zone for treatment operations.

FIGS. 2-5 show a sequence of operation of a non-limiting embodiment of a set down tool 200 carried by the inner string 160 and disposed inside the outer string 120 shown in FIG. 1. The outer string 120 is shown to include a locating or indicating profile 290 and a set down profile 295. In one aspect, the locating profile 290 includes a lower profile 292*a* and an upper profile 292*b* with a locking indent 292*c* therebetween. The set down profile 295 includes a lower shoulder (referred to herein as the set down shoulder) 295*a* and an upper shoulder 295*b*. The set down tool 200 includes a set down device 210 on the outside of a mandrel 202. The mandrel 202 includes a mechanical stop 202*a*. The set down device e 210 includes a set down section 210*a*, an alignment section 210*b* and a locating section 210*c*. The set down section 210*a* includes: a set down collet 220 configured to selectively set down the tool 200 in any of the set down profiles 295 in the outer string 120. The alignment section 210*b* includes an alignment or activating device 240 that enables or activates the set down collet 220 to set down in the selected set down profile 295 and a locking device, such as collet 270 that operates or activates the alignment device 240, while maintaining a locating collet 290 in the locating section 210*c* engaged with the locating profile 290 in the outer string. 120.

Figure 2:
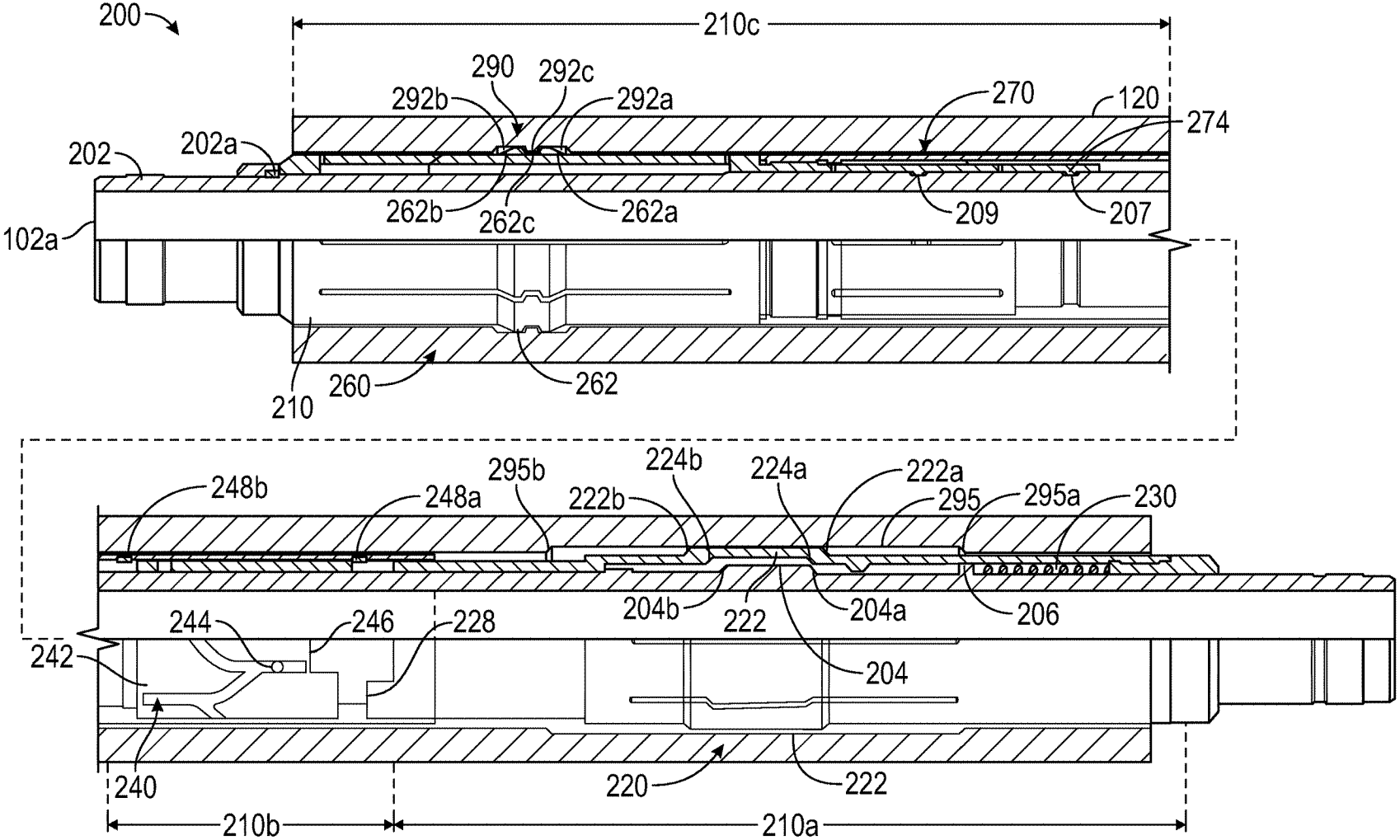
FIG. 2 shows a non-limiting embodiment of a set down tool in an initial or run-in position before the set down tool is set down at a desired or selected location in the outer string.

The set down collet 220 includes an outer profile 222 having a lower shoulder 222*a* and an upper shoulder 222*b*. The set down collet 220 has an inner profile 224 that includes shoulders 224*a* and 224*b*. The mandrel 202 includes an outer set down profile 204 having shoulders 204*a* and 204*b*. The inner profile 224 of set down collet 220 is configured to engage with the profile 204 of the mandrel 202. In FIG. 2, the inner profile 222 of the set down collet 220 is shown engaged with the outer profile 204 of mandrel 202. A biasing member, such as spring 230, in the set down collet 220 is retained by a retaining pin 206 on the mandrel 202. In one non-limiting embodiment, the alignment section 210*b* may include an alignment device, such as an indexing device 240, that includes an indexing sleeve 242 containing a number of axial travel slots 245 and a pin 244 that travels or moves in such slots to cause the indexing sleeve 242 to rotate about the mandrel 202. Thus, indexing sleeve 242 rotates about the mandrel 202 when indexing pin 244 travels axially (one stroke up or down) inside slots 245. In one aspect, the indexing sleeve 242 may be configured to complete one rotation in any desired number of axial movements of the pin 244 in the slots 245. In the particular configuration of FIG. 2, the indexing sleeve 242 completes one rotation in four axial strokes of the pin 244. The indexing sleeve 242 further includes a notch 246 (hidden in FIG. 1 but visible in FIGS. 4 and 5) at its lower end 242*a*. The set down collet 220 includes a pin member 228 at its upper end 220*b* that mates with the notch 246 of the indexing sleeve 242 when the indexing sleeve 242 is in an alignment position, as shown and described in reference to FIGS. 4-5. The indexing sleeve 242 does not move axially within the set down device 210 and is retained in position by a lower indexing sleeve stop 248*a* and an upper indexing sleeve stop 248*b*. Pin 244 is attached to the mandrel 202 and thus, when the mandrel 202 moves upward inside the setting device 210, pin 244 moves in one of the slots 245 and when the mandrel 202 moves downward inside the setting device 210, pin 244 moves in the next adjacent slot 245 in the indexing sleeve 242, thereby causing the indexing sleeve 242 to rotate about the mandrel 202 one-fourth of a turn with each axial stroke of the pin 244.

The indicating collet section 210*c* includes an indicating collet or locating collet 260 that includes a locating profile 262 having a lower profile 262*a*, an upper profile 262*b* and a locking indent 262*c*. As discussed earlier in reference to FIG. 1, the outer string 120 includes an indicating profile 290 corresponding to each zone. In one non-limiting embodiment, the indicating profile 262 of the indicating collet 260 may be configured to engage with only the locating or indicating profiles 290 in the outer string 120. In one aspect, the indicating profile 262 may be configured such that when the set down tool 200 moves in the downward or downhole direction, the profile 262 will not engage with any of the profiles 290 or any other profile in the outer string 120. The profile 262, however, may be configured to engage with each locating profile 290, to the exclusion of any other profile in the outer string 120, to engage with each locating profile 290 when the set down tool 200 is moved in the upward or uphole direction. As described later, this allows the set down tool 200 to locate and set down at any selected set down location in the outer string 120. Therefore, when the inner string 160 with the set down device 210 having indicating collet profile 260 moves within the outer string 120, the indicating profile 262 on the indicating collet 260 will engage only with the indicating profiles 290 on the outer string 120 in the upward direction.

The locking collet 270 includes an inner profile 274 configured to engage with each of the spaced-apart locking profiles or grooves 207 and 209 in the mandrel 202. In FIG. 1, the indicating collet 260 is shown engaged with the indicating profile 290 in the outer string 120, the locking collet 274 is shown engaged with the lower locking profile 207 in the mandrel 202, the pin 228 of the set down collet 220 is not engaged with or in alignment with notch 246 of the indexing sleeve 242 and the set down collet shoulder 222*a* is not abutting against the lower shoulder 295*a* of the set down profile 295. In one aspect, the load (F1) required to disengage or move the locking collet 270 from the locking grooves 207 or 209 in the mandrel 202 is less than the load (F2) required to disengage the indicating profile 262 of the indicating collet 260 from the indicating profile 290. Thus, when the indicating collet profile 262 is engaged with the profile 290 in the outer string 120 and the locking collet 270 is engaged with either of the locking profiles 207 or 209, a load between two such loads (F1 and F2) will cause the mandrel 202 to move between the locking profiles 207 and 209, causing the pin 244 to travel axially in one of the slots 245, causing the index sleeve 242 to rotate one-fourth of a turn, without disengaging the collet 260 from the locating profile 290.

Figure 3:
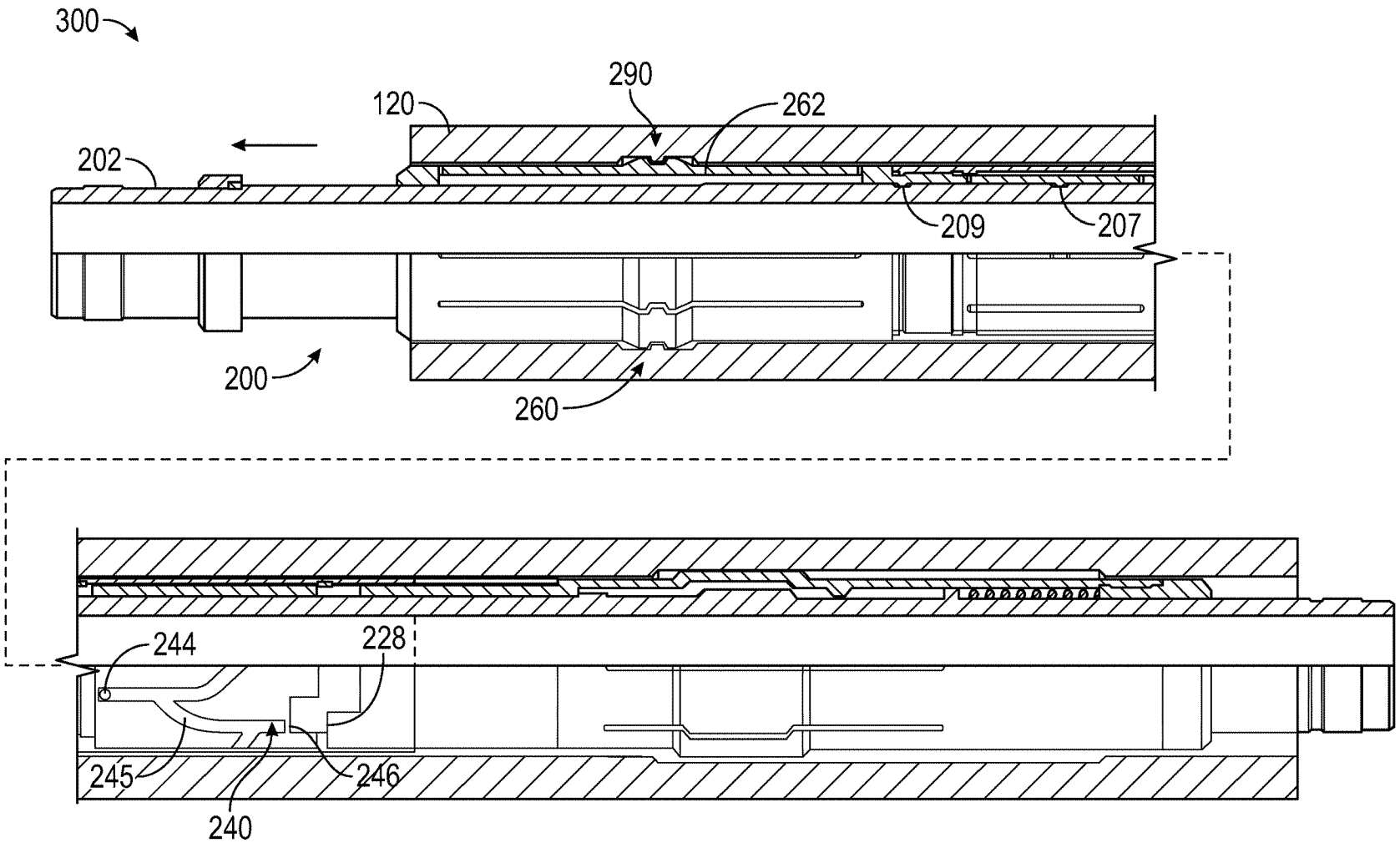
FIG. 3 shows the set down tool of FIG. 2 wherein an alignment device has been cycled once for activating a set down device for setting down the set down tool at the selected location by a locking device.

FIG. 3 shows a configuration 300 of the set down tool 200 in which the indexing sleeve 242 has been rotated one segment by moving the mandrel 202 upward (uphole) from the configuration shown in FIG. 2. When the mandrel 202 is pulled upward or uphole with a load between F1 and F2, the indicating profile 262 of the indicating collet 260 remains engaged with the locating profile 290. Such a load, however, is sufficient to cause the locking collet 270 to disengage from the locking profile 207 and allow the mandrel 202 to move upward, which allows the locking profile 209 to engage with the locking collet 270. Moving the locking profile 207 upward, causes the pin 245 to travel axially, causing the indexing sleeve 242 to rotate one segment. The set down collet 220 remains in the same position as shown in FIG. 2 as the pin 228 is not yet aligned with the notch 246 of the indexing sleeve 242. The index sleeve rotates one segment with each axial stroke (up or down) of the mandrel.

Figure 4:
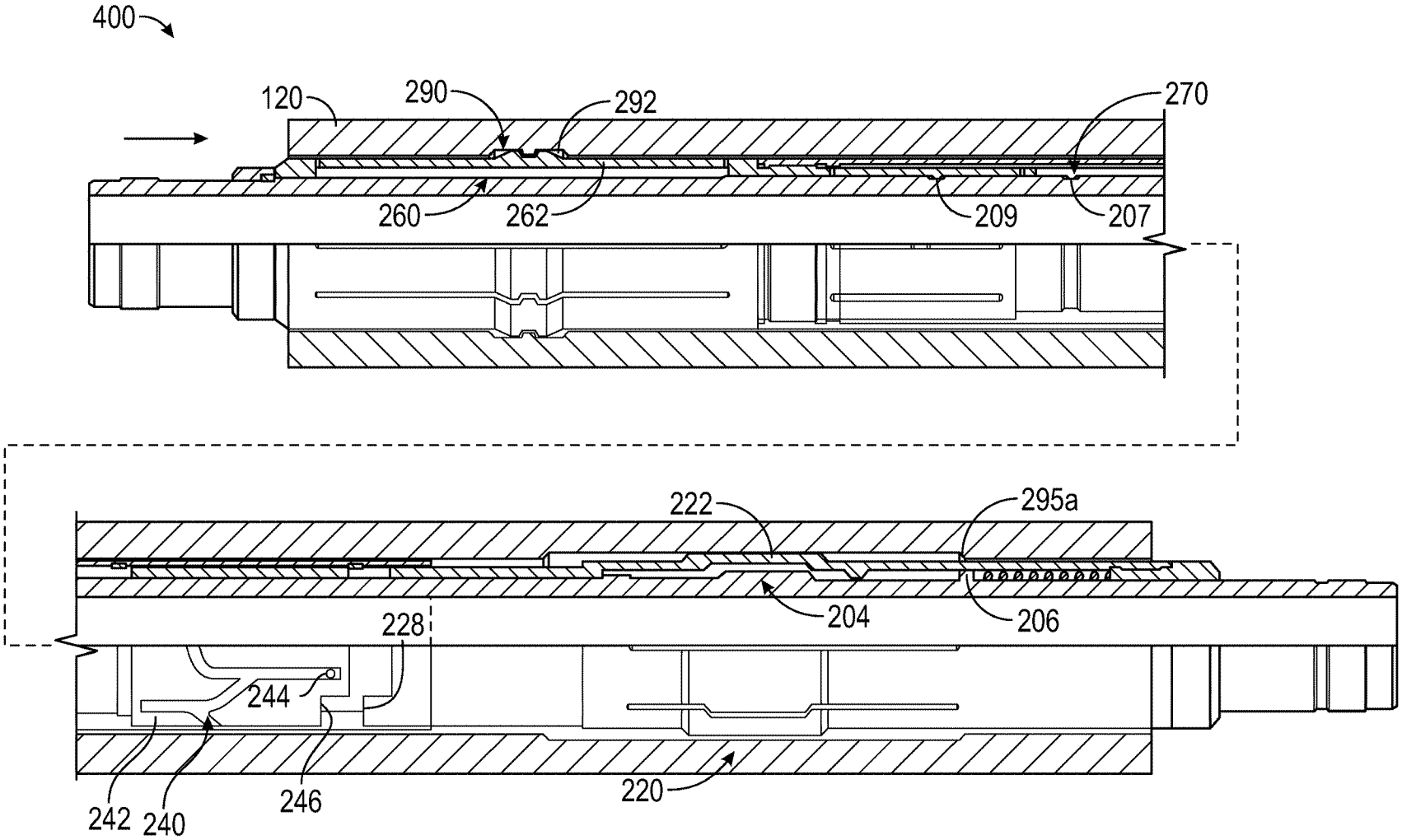
FIG. 4 shows the set down tool of FIG. 3 wherein the alignment tool has been cycled to activate a set down device so that it can be set down at the selected location.
Figure 5:
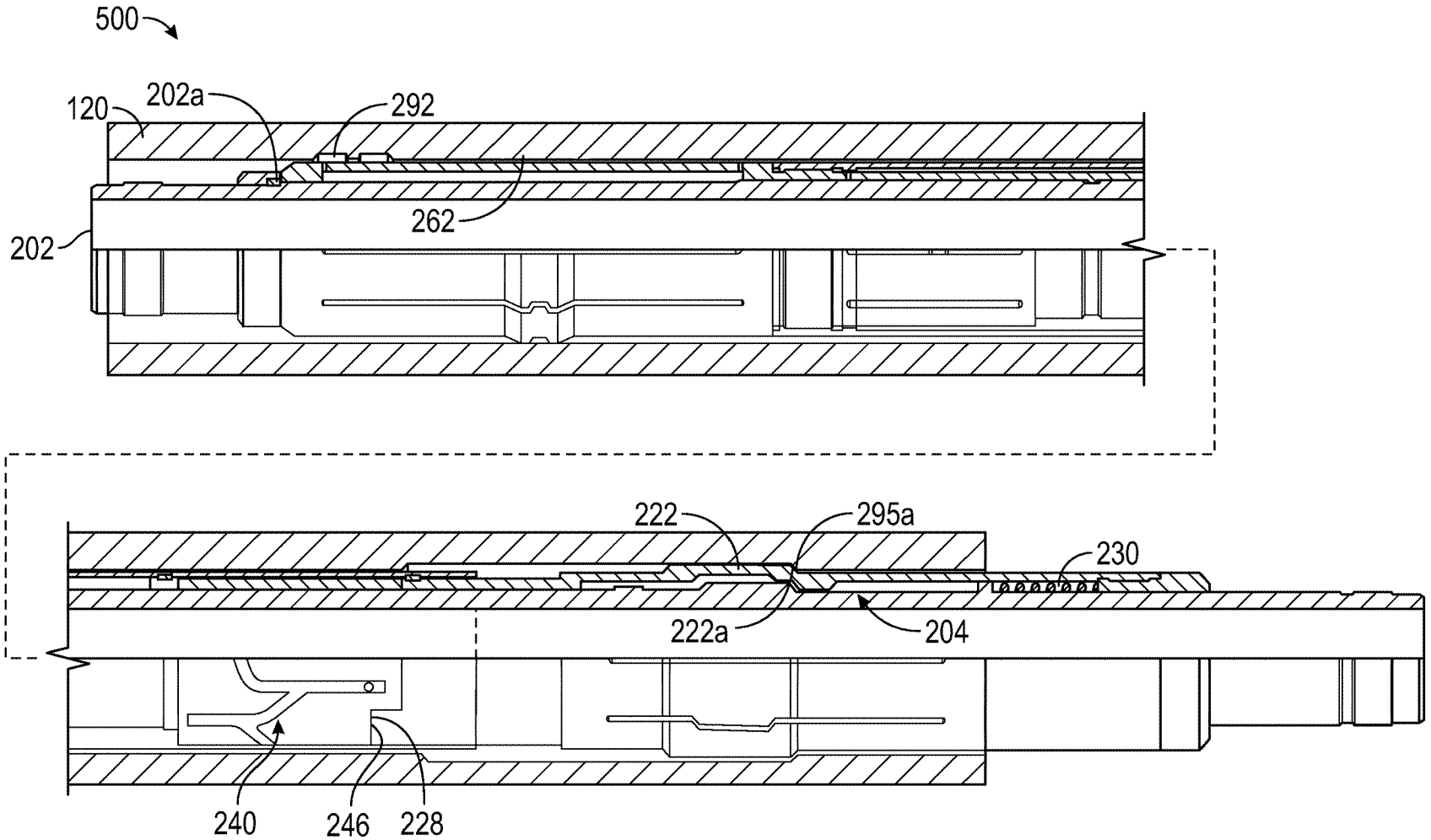
FIG. 5 shows the set down tool of FIG. 4 in the set down position at the selected location.

FIG. 4 shows a configuration 400 of the set down tool 200 when the indexing sleeve 242 has been rotated another segment by moving the mandrel 202 downward (downhole) to align the pin 228 of the set down collet 220 with the notch 246 of the indexing sleeve 242. When the mandrel 202 is moved downward from the configuration of FIG. 3 with a load between F1 and F2, the indicating profile 262 of the indicating collet 260 remains engaged with the locating profile 290. The load being greater than F1 causes the locking profile 209 to disengage from the locking collet 270 and allows the mandrel 202 to move downward causing the locking profile 207 to engage with the locking collet 270, as shown in FIG. 4. Moving (or cycling or shifting) the locking positions between 207 and 209 causes the pin 244 to travel along one of the slots 245, thereby rotating the indexing sleeve 242 one segment (in this case one-fourth of a completed turn). The configuration of FIG. 4 shows that notch 246 of the indexing sleeve is now aligned with the pin 228 of the set down collet 220. Therefore, the set down collet 220 is activated and is capable of moving. As shown in FIG. 5, applying a downward load on the mandrel 202 above F2 will cause the mandrel 202 to move downward to cause the stop 202*a* to engage the set down device 210 and apply the load on the set down device 210, causing the indicting profile 262 to disengage from the locating profile 292. Moving the mandrel downward causes pin 228 to engage in notch 246 and allows the set down collet 220 to move downward, which causes the shoulder 222*a* of the set down collet 220 to abut against the set down shoulder 295*a* of the set down profile 295, thereby setting the set down tool 200 at the selected location 290 in the outer sting.

Thus, in the non-limiting embodiment of FIGS. 2-5, the locking collet 270 is configured to respectively lock in with the spaced-apart locking profiles or grooves 207 and 209 on the mandrel 202. Locking collet 270 maintains the locating collet 260 in its neutral position, i.e., engaged with the locating profile 290 in the outer string 120, as shown in FIG. 2. In one aspect, the locking collet 270 along with the grooves 207 and 209 prevent unintentionally cycling (i.e., up and down from the neutral position) of the locating collet 260. The locking collet 260 in essence generates resistance to motion that enables the locating collet 260 to become engaged with the locating profile 290. Also, the last motion of the mandrel 202 downward can align the set down collet 220, push the locating collet 260 through the locating profile 290 and move the set down collet 220 to the set down position, i.e., moves the set down collet 220 to shoulder out at shoulder 295*a*, beyond which the set down tool 200 cannot move. Moving the mandrel upward 202 from this position will rotate the indexing sleeve 242 one cycle, which would release the set down collet 220 from its aligned position (i.e., unlock the collet 220). The spring 230 would then move the set down collet 220 upward in the position shown in FIG. 1. Thus, in aspects, the set down tool 200 includes an apparatus that holds the locating collet 260 in its neutral or engaged position in the outer string 120 while the indexing or alignment device 240 activates the set down collet 220.

Figure 6:
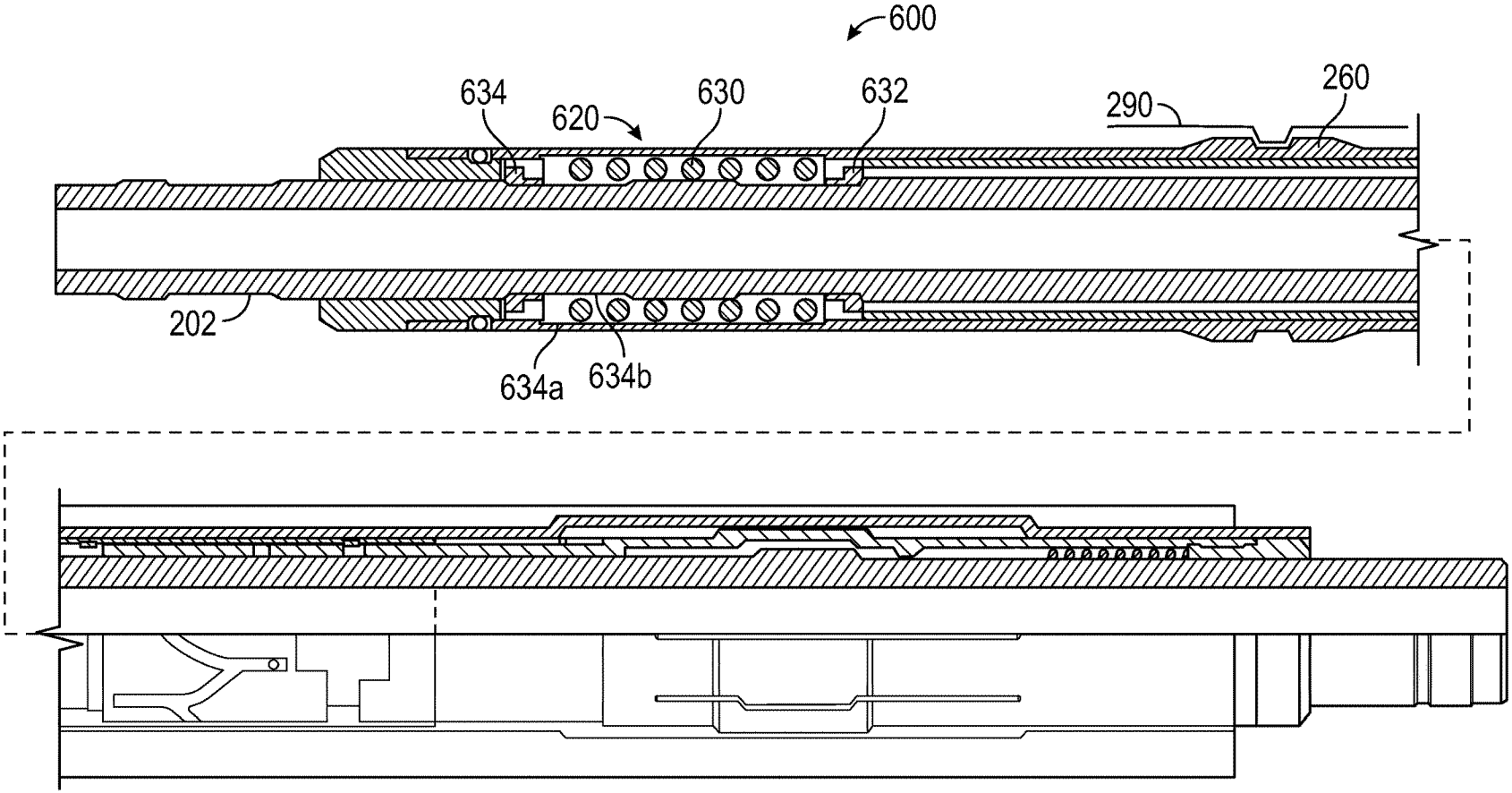
FIG. 6 shows an alternative embodiment of a locking device or operating the alignment device for use in the set down tool of FIG. 1.

FIG. 6 shows an alternative embodiment of the set down tool 600 that utilizes a bidirectional pre-loaded spring device 620 as the locking device for operating the alignment device 240. The locating collet 260, the indexing device 240 and the set down collet 220 remain the same as shown in FIG. 2. In one non-limiting embodiment, the locking device 620 includes a bidirectional pre-loaded spring 630 between a lower stop 632 and an upper stop 634. Referring to FIGS. 2 and 6, pushing the mandrel 202 downward with a force between F3 and F4 moves the mandrel 202 from a first position 634*a* to 634*b*, causing the index sleeve 244 to rotate one segment, while maintaining the locating collet 260 engaged with the locating profile 290. Moving the mandrel 202 upward will rotate the index sleeve one segment and move the spring 630 back to its neutral position shown in FIG. 6 while maintaining the locating collet 260 engaged with the locating profile 290. Once the set down collet 220 has been activated or aligned, moving the set down tool 600 downward with a force greater than F3 will cause the set down tool 600 to set down in the set down profile 295 as described in reference to FIG. 5.

After completion of a downhole operation, such as a treatment operation, the inner string 160 may be moved to another location having a locating profile 290 to perform another downhole operation. For ease of explanation, the embodiments of the set down tool 200 and their operations are described in relation to an inner string 160 inside an outer string 120 for performing a treatment operation, such as fracking. Such tools, however, may be utilized in any other system. In the embodiment described herein, each indicating profile 190 is same so that the set down tool can locate each such profile and set down the inner string at the selected location to treat any desired zone.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a set down tool that includes:

a first collet configured to engage with a profile of an outer member at a selected location, the first collet having a locking indent that engages the profile of the outer member;

a second collet configured to set down in a set down profile in the outer member when the second collet is activated;

an indexing sleeve for activating the second collet; and a spring that allows a mandrel to move to rotate the indexing sleeve while maintaining the first collet engaged with the profile of the outer member.

2. The apparatus of claim 1, wherein the spring is preloaded and enables the mandrel to move within the first collet and the second collet.

3. A method of performing an operation in a wellbore; comprising:

conveying a service assembly into a wellbore, the service assembly including an outer string having a plurality of spaced apart locating profiles and set down profiles and an inner string having a set down tool that includes:

a locating device configured to engage with a locating profile on the outer string at a selected location, the locating device including an indent that engages the locating profile of the outer string;

a set down collet configured to set down in the set down profile in the outer string when a set down device is activated;

an indexing sleeve for activating the set down collet; and a spring that allows a mandrel to move to rotate the indexing sleeve while maintaining the first collet engaged with the profile of the outer member:

engaging the indent of the locating device with a selected locating profile;

moving the mandrel against the spring to rotate the indexing sleeve, while maintaining the locating device engaged with the selected locating profile; and moving the set down tool to set down the set down device in the set down profile.

4. The method of claim 3, wherein the tool includes a locking collet and the mandrel having a first locking profile and a second locking profile, the method further comprising cycling the mandrel within the set down tool a plurality of times to engage the locking collet with the first and second locking profiles to cycle the indexing sleeve to activate the set down device.

5. The method of claim 3, wherein the spring is a preloaded spring around the mandrel and wherein moving the mandrel comprises cycling the mandrel between two positions.

6. The method of claim 3, wherein application of a first load on the locating device disengages the locating device from the locating profile and a second load less than the first load enables the spring to rotate the indexing sleeve.

7. The method of claim 3, wherein the locating device is a first collet, and the set down device is a second collet.

8. The method of claim 7, wherein the mandrel comprises a first locking profile and a second locking profile, and a third collet is configured to engage with the first and second locking profiles and wherein alternately engaging the first and second locking profiles with the third collet rotates the indexing sleeve.

9. The method of claim 3 further comprising applying a first load to the locating device to rotate the indexing sleeve and a second load to disengage the locating device from the locating profile wherein the first load is less than the second load.

10. The method of claim 3 further comprising performing a treatment operation in a zone in the wellbore associated with the selected location.

* * * * *